US011191346B2

(12) United States Patent
Batushansky

(10) Patent No.: US 11,191,346 B2
(45) Date of Patent: Dec. 7, 2021

(54) METHOD AND APPARATUS FOR DETERRING UNAUTHORIZED MOUNTING OF A MOTORCYCLE

(71) Applicant: Paul Batushansky, Brooklyn, NY (US)

(72) Inventor: Paul Batushansky, Brooklyn, NY (US)

( * ) Notice: Subject to any disclaimer, the term of this patent is extended or adjusted under 35 U.S.C. 154(b) by 48 days.

(21) Appl. No.: 16/700,994

(22) Filed: Dec. 2, 2019

(65) Prior Publication Data

US 2021/0161280 A1 Jun. 3, 2021

(51) Int. Cl.
*A45F 4/02* (2006.01)

(52) U.S. Cl.
CPC ..... *A45F 4/02* (2013.01); *A45F 2004/026* (2013.01)

(58) Field of Classification Search
CPC ..... A45F 2004/026; A45F 3/04; A45F 4/02; A45C 7/009; A45C 9/00; A45C 2009/002;

(Continued)

(56) References Cited

U.S. PATENT DOCUMENTS 4,258,869 A * 3/1981 Hilgendorff ..... B62J 9/00 224/429
4,442,960 A * 4/1984 Vetter ..... B62J 9/00 190/108

(Continued)

*Primary Examiner* — Brian D Nash
(74) *Attorney, Agent, or Firm* — Patent Ventures, LLC

(57) ABSTRACT

An apparatus for providing a motorcycle straddle deterrence, said apparatus comprising: a back-pack of foldable material with a back surface, a front surface, one side, another side, a slit on each side, a bottom surface, a top surface with a draw-string opening for accessing at least one compartment, and at least one over-the-shoulder strap disposed on the back surface; the back-pack with the draw-string drawn configured to be folded-in such that the one side and the other side unite to be secured in place by a side-release buckle, wherein the backpack is compact or cylindrical in shape while worn by an operating motorcyclist; said back-pack with the draw-string un-drawn and un-buckled configured to fold out and said back-pack back surface to rest on a top surface of a seat of the motorcycle, wherein the folded-out back-pack covers at least a partial surface of the seat of the motorcycle; a first strap affixed securely to a first side of the motorcycle and said first strap terminating with a hook and a second strap affixed securely to a second side of the seat of the motorcycle and said second strap terminating with a buckle; each of the first strap and second strap inserted through each of the slits disposed on each of the sides of the back-pack gaining access into the at least one compartment of the back-pack and the hook of the first strap hooked into the buckle of the second strap from access through the un-drawn top opening of the back-pack; and draw the top portion of the back-pack closed and lock the top portion closed securing the back-pack housing the helmet on the seat of the motorcycle in an unattended state and deterring unauthorized mounting of the motorcycle and restricting access into the compartment for access to at least one of the helmet and/or buckles for un-buckling the straps and removing the back-pack from the seat of the motorcycle by anyone unauthorized.

20 Claims, 7 Drawing Sheets

(58) Field of Classification Search
CPC ..... A45C 2003/005; B62J 9/00; B62J 9/14; B62J 9/26; B62J 1/18; B62J 1/20
See application file for complete search history.

(56) References Cited

U.S. PATENT DOCUMENTS 4,862,519 A * 9/1989 Bull ..... A45C 1/04 2/66
5,139,187 A * 8/1992 Fowler ..... A45C 9/00 224/576
5,269,023 A * 12/1993 Ross ..... A41D 13/081 126/204
5,499,401 A * 3/1996 Heinmiller ..... A41D 13/081 2/208
5,586,703 A * 12/1996 Radar ..... A45F 3/04 224/148.2
5,603,441 A * 2/1997 Easter ..... A45F 3/00 224/153
5,890,639 A * 4/1999 Hancock ..... A45C 3/00 224/429
6,193,118 B1 * 2/2001 Kearl ..... A45C 7/0095 108/43
6,253,977 B1 * 7/2001 Greger ..... B62J 1/20 150/167
6,637,367 B1 * 10/2003 Dost ..... A01K 1/0353 119/28.5
D544,708 S * 6/2007 Barker ..... D3/216
7,568,600 B2 * 8/2009 Godshaw ..... B62J 9/25 224/429
7,757,911 B2 * 7/2010 Barker ..... A45C 9/00 224/153
8,870,045 B1 * 10/2014 Aguirre ..... A45F 3/04 224/651
10,034,535 B1 * 7/2018 LaForest ..... A45F 4/08
10,464,727 B1 * 11/2019 Rerecich ..... A45F 5/10
2005/0179287 A1 * 8/2005 Hankins ..... B62J 1/20 297/219.11
2008/0061093 A1 * 3/2008 Pottharst ..... A45C 15/00 224/155
2010/0219222 A1 * 9/2010 Winneur ..... A45C 9/00 224/629
2011/0079623 A1 * 4/2011 McCray-Clark ..... A45F 3/04 224/576
2012/0103481 A1 * 5/2012 Nieves ..... A45C 3/06 150/113
2012/0187170 A1 * 7/2012 Ho ..... B62J 9/40 224/441
2014/0124558 A1 * 5/2014 Bowerman ..... A45F 3/02 224/579
2015/0076182 A1 * 3/2015 Coleman ..... A45F 3/04 224/155
2015/0096908 A1 * 4/2015 Nadler ..... A47G 9/1027 206/216
2018/0035823 A1 * 2/2018 Landeros ..... A45F 3/04
2018/0110318 A1 * 4/2018 Ackerman ..... A45F 3/04
2018/0154203 A1 * 6/2018 Schromm ..... A45F 3/04
2018/0192613 A1 * 7/2018 Keith ..... A01K 27/002
2019/0021475 A1 * 1/2019 Lindenmeyer ..... A45F 4/08
2019/0038006 A1 * 2/2019 Woods ..... A47C 7/029
2019/0184862 A1 * 6/2019 Selly ..... A45F 4/02
2019/0269230 A1 * 9/2019 Powell ..... B62J 9/00
2020/0128943 A1 * 4/2020 D'Alessandro ..... A45F 3/047
2020/0268131 A1 * 8/2020 McDowell ..... A45F 3/04
2021/0000231 A1 * 1/2021 Salibi ..... A45C 7/0086
2021/0059387 A1 * 3/2021 Prudente ..... A45F 3/047

* cited by examiner

METHOD AND APPARATUS FOR DETERRING UNAUTHORIZED MOUNTING OF A MOTORCYCLE

FIELD OF INVENTION

The invention pertains generally to the field of motorcycle accessories, and more particularly to a motorcycle accessory preventing unauthorized users from sitting, mounting, or straddling (mounter) a stationary motorcycle.

BACKGROUND OF INVENTION

Based on the most current estimates, there are an estimated 6-8 million registered motorcyclists in the United States. This figure is proportionately even larger in foreign countries that suffer from crippling congestion and poor infrastructure, such as South Asia and Latin America. The same factors that increase the risk of fatalities—open to the environment—also render stationary motorcycles vulnerable to being tampered with by a strange passer-by. The one thing that all 8 million registered motorcyclists have in common is that they tend to be passionate—if not obsessive—regarding their motorcycles. According to a recent poll, motorcycle (bike) enthusiasts are in consensus that they deem strangers sitting, mounting, or straddling (mounters) on their parked bikes as the biggest nuisance.

Beyond just a nuisance, there are significant injury risks to the mounter, not to mention significant risk of liability to the motorcycle owner. Many bikes can be dropped, bringing the mounter down to the ground, or worse, drop on top of the mounter. Also, a mounter may burn his inner thigh or calf on the hot exhaust or engine. This is especially true in the case of children mounting a bike. Aside from the risk of injury or liability, dropping a bike can result in thousands of dollars of damages. In fact, it is not rare for an insurance company to completely write-off drop-related body damages since repairing it would cost more than 75% of the current value of the bike. What's more, most mounter's can't resist turning the throttle while mounting the bike (sound effects optional), often leading to a flooded engine and subsequent ignition issues.

Despite the risk and nuisance posed by mounting a stationary bike, there is currently a void in the market for deterring such behavior. Harley Davidson has recently launched a series of motorcycles that are communicatively coupled to a personalized key fob, whereby when motion or pressure sensors on the motorcycle are triggered in the absence of the key fob, the motorcycle is commanded to trigger an alarm. While this alarm system may incentivize a mounter to remove oneself from the Harley, it does not create any deterrence from mounting the motorcycle in the first place. All of the above mentioned risks may occur immediately after mounting and before the mounter has had a chance to get off. As a matter of fact, the blaring sounds of the alarm may have the unintended effect of exacerbating the mentioned risks due to the alarmed and panicked state of the mounter upon hearing the alarm. Thus, there is a need for a product that deters a mounter from mounting a motorcycle, while the motorcycle is stationary and unattended.

SUMMARY

The invention resides in enabling a motorcyclist to deter and prevent an unauthorized user from sitting, mounting or straddling (mounter) the motorcycle, while the motorcycle is stationary and unattended—in order to reduce the risks inherent in straddling.

Advantageously, unlike the Harley Davidson key fob-mediated alarm system, there is no need for electronics or short-range electronic communication in order to deter the mounting. Moreover, beyond providing for a deterrence for mounting, the invention doubles as a useful back-pack while in operation. The invention provides for the deterrence by forming a hump over the seat from the storage of a helmet—or any other motorcycle accessory—while stationary.

It is one object of the present disclosure to provide an apparatus for providing a motorcycle mount deterrence comprising: a back-pack of foldable material with a back surface, a front surface, one side, another side, a slit on each side, a bottom surface, a top surface with a draw-string opening for accessing at least one compartment, and at least one over-the-shoulder strap disposed on the back surface; said back-pack with the draw-string un-drawn and said back-pack back surface to rest on a top surface of a seat of the motorcycle, wherein the back-pack back surface covers the top surface of the seat of the motorcycle; a first strap affixed proximal to a first side of the seat of the motorcycle and said first strap terminating with a hook and a second strap affixed proximal to a second side of the seat of the motorcycle and said second strap terminating with a buckle; each of the first strap and second strap inserted through each of the slits disposed on each of the sides of the back-pack gaining access into the at least one compartment of the back-pack and the hook of the first strap hooked into the buckle of the second strap by access through the un-drawn top opening of the back-pack; and draw the top portion of the back-pack closed and lock the top portion closed securing the back-pack housing the helmet on the seat of the motorcycle in an unattended state and deterring unauthorized mounting of the motorcycle and restricting access into the compartment for access to at least one of the helmet and/or buckles for un-buckling the straps and removing the back-pack from the seat of the motorcycle by anyone unauthorized.

It is another object of the present disclosure to provide for an apparatus preventing unauthorized mounting of a motorcycle, said apparatus comprising: a first strap affixed proximal to a first side of a seat of the motorcycle and said first strap terminating with a hook and a second strap affixed proximal to a second side of the seat of the motorcycle and said second strap terminating with a buckle; each of the first strap and second strap inserted through each of a slit disposed on each side of a back-pack gaining access into at least one compartment of the back-pack and the hook of the first strap hooked into the buckle of the second strap by access through an un-drawn top opening of the back-pack; and draw the top portion of the back-pack closed and lock the top portion closed securing the back-pack housing a helmet on the seat of the motorcycle in an unattended state and deterring unauthorized mounting of the motorcycle and restricting access into the compartment for access to at least one of the helmet and/or buckles for un-buckling the straps and removing the back-pack from the seat of the motorcycle by anyone unauthorized.

It is yet another object to provide for a method for preventing unauthorized mounting of a motorcycle, comprising the steps of: affixing a first strap proximal to a first side of a seat of the motorcycle and said first strap terminating with a hook and affixing a second strap proximal to a second side of the seat of the motorcycle and said second strap terminating with a buckle; inserting each of the first strap and second strap through each of a slit disposed on each side of a back-pack gaining access into at least one compartment of the back-pack and hooking the first strap into the buckle of the second strap by accessing through an un-drawn top opening of the back-pack; and drawing the top opening of the back-pack closed and lock the top portion closed securing the back-pack housing the helmet on the seat of the motorcycle in an unattended state and deterring unauthorized mounting of the motorcycle.

DETAILED DESCRIPTION

Figure 1:
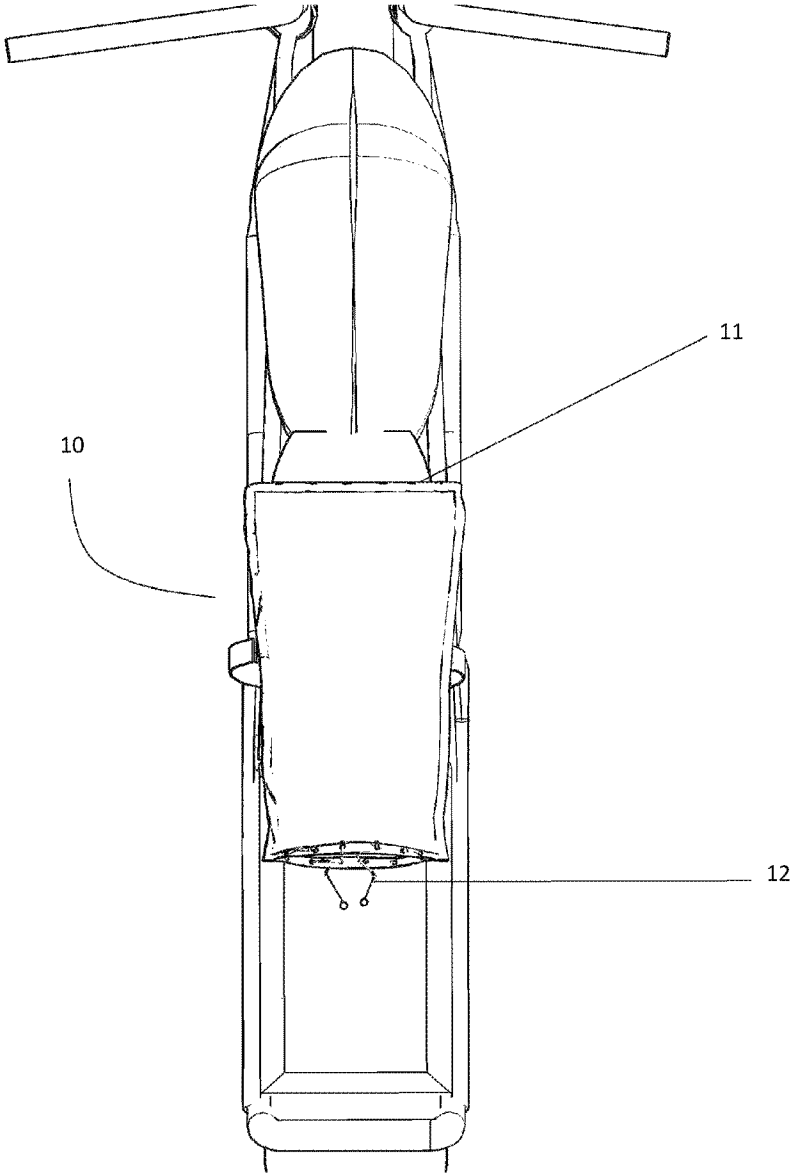
FIG. 1 depicts a top-down view of the back-pack mounted onto a seat of a motorcycle in accordance with an aspect of the invention.

FIG. 1 depicts a top-down view of the back-pack mounted onto a seat of a motorcycle in accordance with an aspect of the invention. As depicted in FIG. 1, the apparatus for providing a mount deterrence may appear as a standard back-pack 10 securely affixed to a top of the seat 11 of a motorcycle, wherein the back-pack back surface is at least partially covering the surface of the seat 11. The affixed back-pack 10 enclosed with a helmet provides the necessary deterrence for mounting the motorcycle. It is conceivable for the back surface of the back-pack 10 to under-cover or over-cover the surface of the seat 11. In the case of under-covering, even if a portion of the seat 11 is exposed, it is in all likelihood still serving as a deterrence for a mounter to mount the motorcycle since the portion exposed is not large enough for a person of average size to sit on. In the case of over-covering, even if a portion of the back-pack 10 is hanging over the edge of the seat 11, since it is securely affixed to the seat, it will still serve as a deterrence to mounting. The size constraints to consider are: The back-pack 10 must be large enough to house a helmet, or optionally, any object large enough to form a hump while housed in the back-pack in order to deter mounting while affixed to the surface of the seat 11; while still being small enough to optionally collapse into a strapped cylinder and worn over the shoulders of a motorcyclist while riding.

As further shown in FIG. 1, the top portion of the back-pack 10 is opened and closed by a drawing or cinching action of a draw-string 12. Once the back-pack 10 is positioned over the seat 11 of the stationary motorcycle, it is un-drawn to open in order to house the helmet of the motorcyclist. While not shown, the back-pack 10 must have at least one large compartment for housing the helmet. Optionally, there may be additional smaller compartments within the interior larger compartment. Alternatively, the exterior surface of the back-pack 10 may have additional compartments that may be accessed from the outside. However, as one can imagine, compartments that may be gained access to from the outside are not ideal since items contained within the outer compartments may be vulnerable to theft while the motorcycle is unattended. Also not shown, the front surface of the back-pack 10 may further comprise side straps with side-release buckles to allow a user to further fold in or collapse the back-pack 10 into a cylinder form for minimizing wind resistance during riding the motorcycle.

The back-pack 10 may take on any one of a style, so long as it is comprised of a form-factor enabling for housing a helmet in the stationary (affixed) state, and collapsible (foldable) into a cylinder-form to be worn over the shoulders of a rider in the ride state. As shown, it is a cinch-draw tote or back-pack 10 with double over-the-shoulder straps. While not shown, internal compartments may house items such as keys or mobile phone. Additionally, while not shown, a zippered bottom surface may be separate from the main helmet-housing compartment and serve to house smaller items such as sneakers or shoes. Alternatively, rather than the double over-the-shoulder strap, a single messenger-bike type carry strap may be possible. The material may be tough and durable, while still being foldable. It may be tough and durable in order to withstand being cut or torn with a standard scissor or knife, while still being foldable in order to collapse into a cylinder form. Examples of material may be any one of, or at least one of, canvas, leather, nylon, ripstop nylon, or any cut, abrasion, and tear-resistant material. Alternatively, the material may not be cut, abrasion, or tear resistant, and just be foldable or pliable. In some embodiments, the back-pack 10 may not need to be folded into a cylindrical form during active riding, and instead, just worn over the shoulders of the rider as-is. While drag may be increased in comparison to the foldable (cylindrical) form, the drag may not be significant enough to warrant a foldable embodiment.

Figure 2:
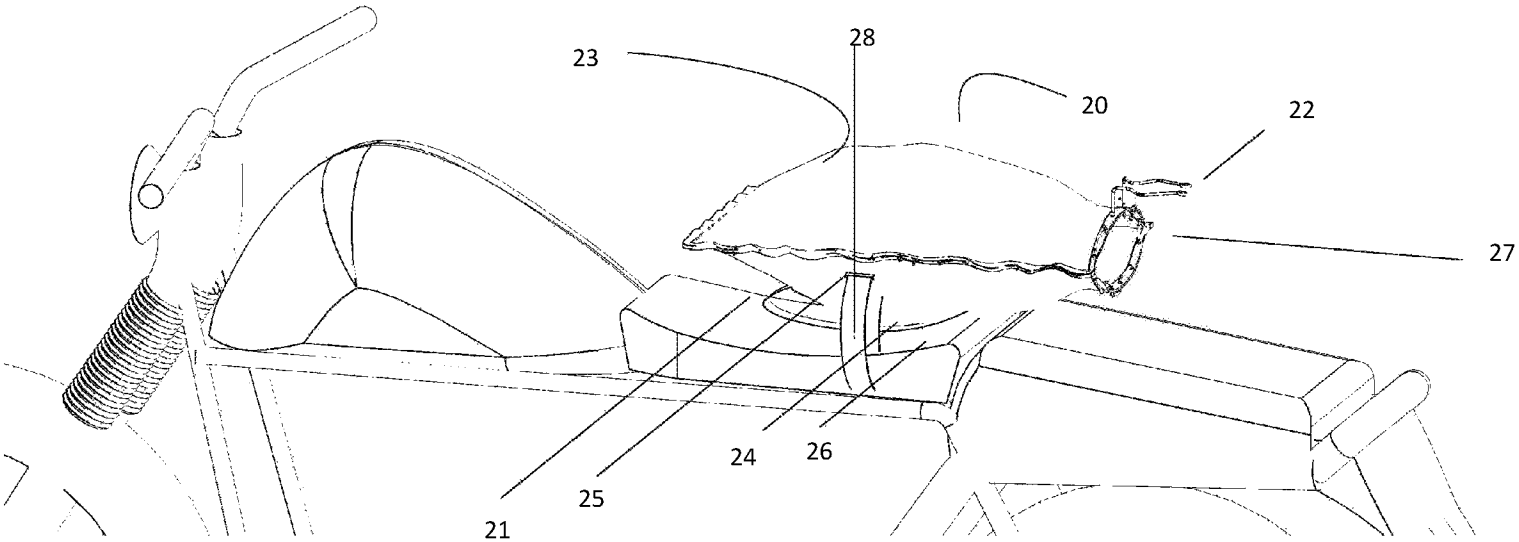
FIG. 2 depicts a side-view of the back-pack mounted onto a seat of a motorcycle in accordance with an aspect of the invention.
Figure 3:
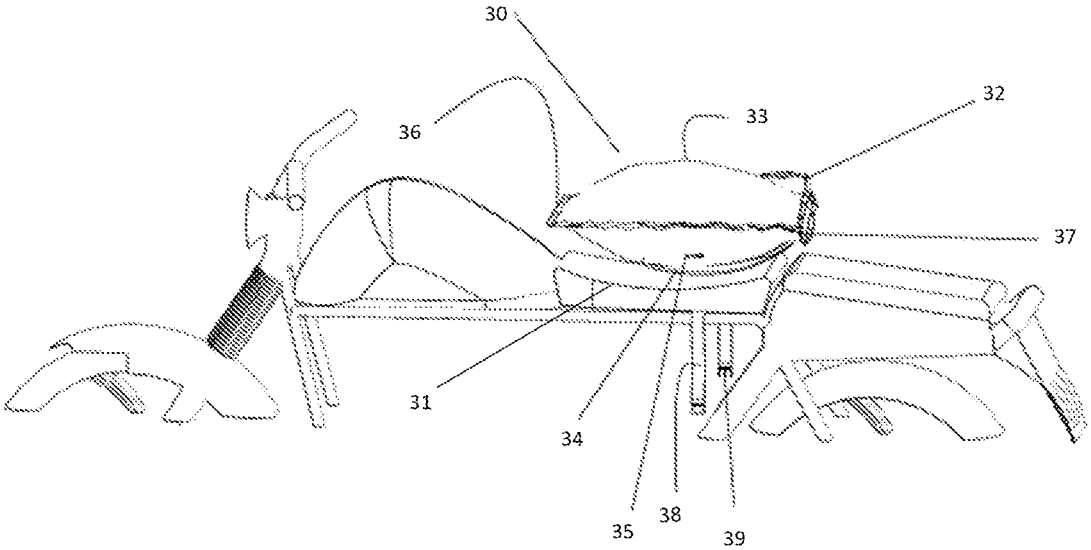
FIG. 3 depicts a side-view of the back-pack un-securely mounted onto a seat of the motorcycle in accordance with an aspect of the invention.

Now in reference to FIG. 2 and FIG. 3. FIG. 2 depicts a side-view of the back-pack mounted onto a seat of a motorcycle in accordance with an aspect of the invention and FIG. 3 depicts a side-view of the back-pack un-securely mounted onto a seat of the motorcycle in accordance with an aspect of the invention. As depicted in FIGS. 2 and 3, the apparatus provides for a mount deterrence by comprising: a back-pack 20, 30 of foldable material with a back surface, a front surface 23, 33, one side 24, 34, another side, a slit 25, 35 on each side, a bottom surface 26, 36, a top surface with a draw-string 22, 32 opening for accessing at least one compartment, and at least one over-the-shoulder strap disposed on the back surface; the back-pack 20, 30 with the draw-string 22, 32 drawn, wherein said back-pack 20, 30 back surface to rest on a top surface of a seat 21, 31 of the motorcycle; a first strap 28, 38 affixed proximal to a first side of the seat 21, 31 of the motorcycle and said first strap 28, 38 terminating with a hook 39 and a second strap affixed proximal to a second side of the seat 21, 31 of the motorcycle and said second strap terminating with a buckle or loop; each of the first strap 28, 38 and second strap inserted through each of the slits 25, 35 disposed on each of the sides 24, 34 of the back-pack 20, 30 gaining access into the at least one compartment of the back-pack 20, 30 and the hook 39 of the first strap 28, 38 hooked into the buckle or loop of the second strap by access through the un-drawn top opening 27, 37 of the back-pack 20, 30; and draw the top portion 27, 37 of the back-pack 20, 30 closed and lock the top portion 20, 30 closed securing the back-pack 20, 30 housing the helmet on the seat 21, 31 of the motorcycle in an unattended state and deterring unauthorized mounting of the motorcycle and restricting access into the compartment for access to at least one of the helmet and/or hook 39 for un-hooking the straps 28, 38 and removing the back-pack 20, 30 from the seat 21, 31 of the motorcycle by anyone unauthorized.

In another embodiment, the apparatus for deterring mounting comprises: a first strap 28, 38 affixed proximal to a first side of a seat 21, 31 of the motorcycle and said first strap 28, 38 terminating with a hook 39 and a second strap affixed proximal to a second side of the seat 21, 31 of the motorcycle and said second strap terminating with a buckle or loop; each of the first strap 28, 38 and second strap inserted through each of a slit 25, 35 disposed on each side 24, 34 of a back-pack 20, 30 gaining access into at least one compartment of the back-pack 20, 30 and the hook 39 of the first strap 28, 38 hooked into the buckle or loop of the second strap by access through an un-drawn top opening of the back-pack 20, 30; and draw the top portion 27, 37 of the back-pack 20, 30 closed and lock the top portion 27, 37 closed securing the back-pack 20, 30 housing a helmet on the seat of the motorcycle in an unattended state and deterring unauthorized mounting of the motorcycle and restricting access into the compartment for access to at least one of the helmet and/or hook 39 for un-hooking the straps 28, 38 and removing the back-pack 20, 30 from the seat 21, 31 of the motorcycle by anyone unauthorized.

While not shown, some embodiments may further comprise a left and right flap that disposed on the front surface of the back-pack, wherein the right and left flap hook each other by at least one of a hook, loop, or buckle. The flaps may be un-hooked and drape each side of the motorcycle, covering the sides of the seat, and possibly portions of the engine or other components residing below the seat. This drape or skirt may create an illusion of a larger apparatus, and as a result, create a greater deterrence to sitting, straddling, or mounting of the motorcycle. Advantageously, the flaps hooked up may further aid in creating a bundled cylindrical form of the back-pack while over the shoulders of a rider or motorcyclist during riding. Also not shown, the sides of the back-pack 20, 30 may be disposed with a hook on one side and a loop or buckle on the other side of the back-pack, enabling a user to fold-in the back-pack and hook or buckle the two sides together to form the bundled cylindrical form mentioned above.

As shown, the back-pack 20, 30 while mounted onto the seat 21, 31, may convex (hump) as a result of the helmet being housed within the inner compartment of the back-pack 20, 30. The hump or protrusion is what serves as the physical impediment to sitting, straddling, or mounting of the stationary and unattended motorcycle. In some embodiments, rather than a helmet, any number of large objects may be housed within the compartment of the back-pack 20, 30 to cause the seat-mounted back-pack to hump, and hence, deter a mounter. The back-pack 20, 30 may have a form factor configured to house any spherical, cubic, rectangular, elliptical, semi-spherical, or semi-elliptical object large enough to cover a substantial portion of a surface of the motorcycle seat 21, 31.

While not shown, the back-pack may contain multiple compartments. The slits on either side may access the same primary compartment that is also accessed by the top portion or opening of the back-pack. In some embodiments, this inner compartment may further comprise additional compartments for storing smaller items such as a mobile phone, keys, wallet, etc. Alternatively, a larger zippered compartment may reside at the bottom portion of the back-pack that may be accessed from within the primary compartment or from the outside of the back-pack. Obviously, due to the fact that the back-pack is left unattended while mounted on the surface of the seat, restricting access to compartments from within a locked primary compartment is advantageous, versus gaining access from the outside. Alternatively, outer access may still be viable if coupled with a locking means.

Figure 4:
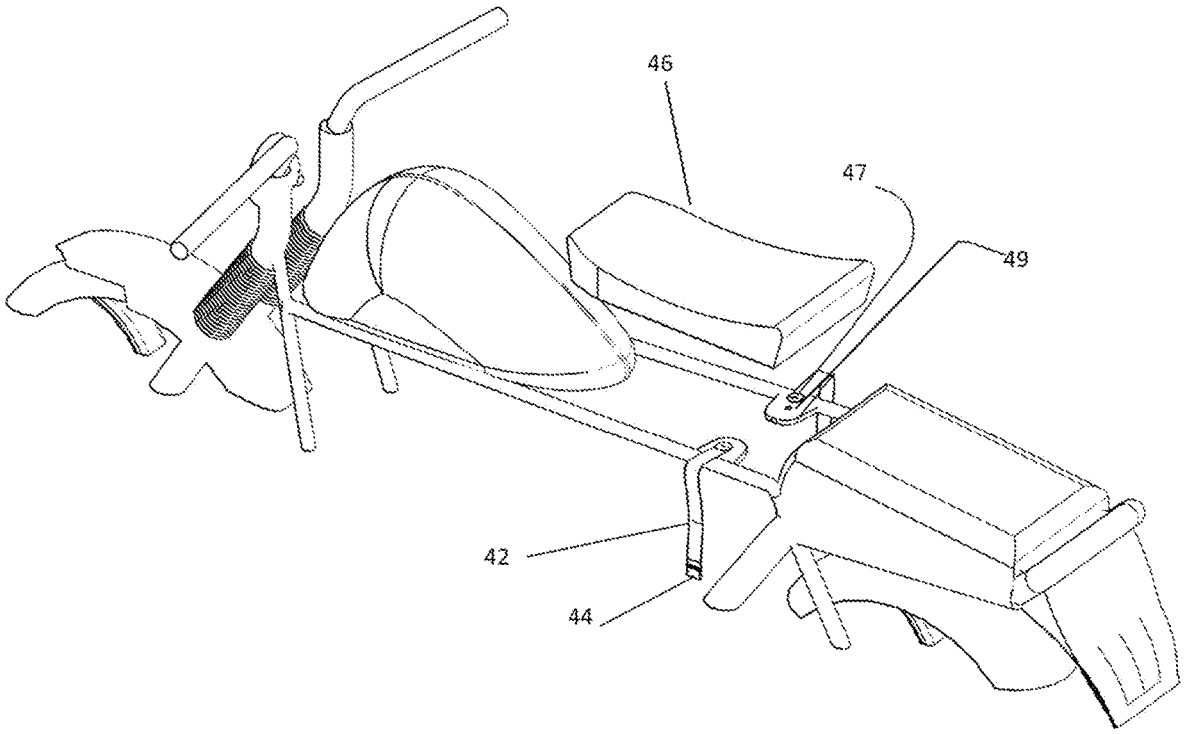
FIG. 4 depicts a close-up illustrating how the straps are affixed proximal to a side of a seat in accordance with an aspect of the invention.

FIG. 4 depicts a close-up illustrating how the straps are affixed proximal to a side of a seat in accordance with an aspect of the invention. As shown, additional mounting plates are not necessary in order to affix the straps 42 proximal to a side of a seat 46. The straps 42 are configured on an end opposing the hook, loop, or buckle 44 with an end piece 47 disposed with a screw hole. This end piece 47 simply co-opts the existing screw hole 48 disposed on a bottom surface or side of a seat 46 and the existing screw hole 49 disposed on a top surface of the frame or chassis, proximal to a side of the seat 46. The end piece 47 would simply be screwed in between the seat screw hole 46 and the top surface of the chassis or frame screw hole 49. Once screwed or installed, there will be no need to re-install and the strap 42 would simply dangle while the motorcycle is not strapped-mounted with the back-pack. It is conceived that the straps 42 would be of a certain length in order to comfortably strap and buckle in within the inner compartment of the back-pack, while not being long enough to create a nuisance while dangling as the user is riding the motorcycle.

While not shown, a strap mounting plate may be used to mount the straps on a frame or chassis of the motorcycle, proximal to a side of a seat of the motorcycle. There may be one strap mounting plate on each side of the chassis or frame, proximal to the seat. The plate may comprise screw holes on each corner for accepting washer and screws to securely mount the plate on the surface of the chassis or frame. Preferably, the plate would be mounted on the very terminal edge of both sides of the chassis or frame. While not shown, alternatively, a single mount plate may be mounted in the center of the bottom surface of the seat, extending therefrom two straps on either side of the plate.

Figure 5:
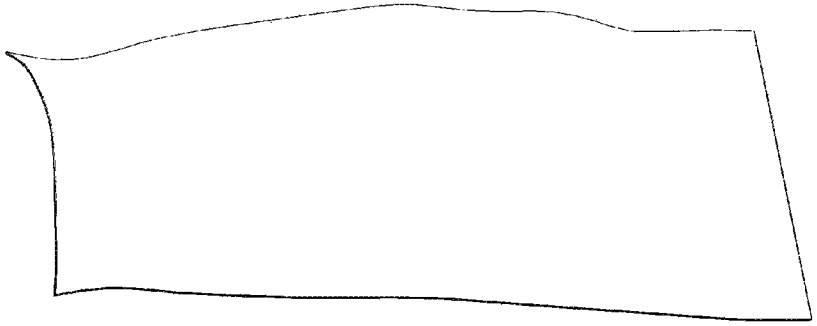
FIG. 5 depicts the inner compartment of the back-pack and terminal ends of the straps hooked in place in accordance with an aspect of the invention.
Figure 5:
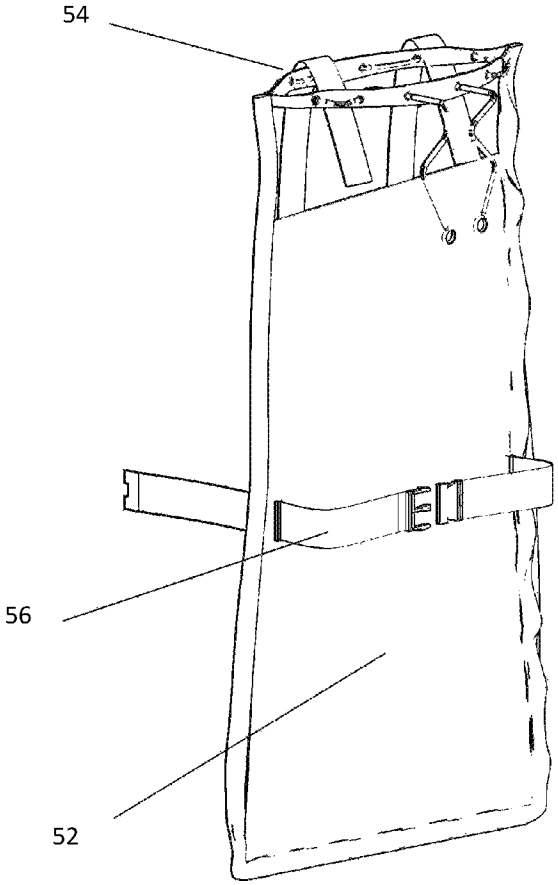

The terminal end of the straps 42 or distal end of the straps 42 terminate in either a hook 44 or buckle/loop 44. The strap 42 length may vary, but should be long enough to be able to insert through the corresponding slit on the side of the back-pack while mounted back-surface down on the seat of the motorcycle. Additionally, the strap 42 length should be long enough to be able to extend through the inner single compartment 52 of the back-pack from a top-portion 54 opening and hook the straps 56 from both sides together in the center of the inner single compartment (FIG. 5 depicting the inner compartment of the back-pack in accordance with an aspect of the invention). While not shown in FIG. 4 or 5, the hardware or mounting kit may also provide for two additional plate mounts to be mounted on each side of the motorcycle, proximal to the seat, thereby allowing the user to hook or secure the distal ends of the straps (hook, loop, or buckle) to prevent the straps from dangling and swaying during operation.

In yet another embodiment, the strap mounting plate may be simply a plate mount without strap and mounted on the side of the motorcycle and proximal to the seat. The straps may be permanently affixed to the back-pack itself and simply buckled and locked to the complementary portion of the plate mount while stationary, and buckled together or to some other portion of the back-pack while riding. The advantage of this particular embodiment is that the straps avoid dangling during riding, as with the other embodiments. However, the disadvantage is that they would require essentially three points of locking during stationary/unattended state, as opposed to just simply one as with the other embodiments.

The strap mounting plate 42 is installed once by the user prior to use and no other installation or hook-up is required on a use-by-use basis. The plate 42 may be delivered, purchased separately as a hardware kit, or purchased with the back-pack. The kit may include a variety of items necessary for mounting—the kit and mounting similar to a standard after-market saddle bag. The kit may include at least one plate, screws, and washers.

Preferably, this hooking of straps 56 and mounting of the back-pack on the seat of the motorcycle is done prior to storing the helmet within the inner single compartment 52 of the back-pack. As shown in FIG. 5, the straps 56 are hooked in the center, laying flat on the bottom surface of the inner compartment 52. It should be appreciated by a person of ordinary skill that the straps 56 may be hooked anywhere in the inner compartment 52, so long as it is accessible by a user from the top portion 54 opening for hooking and un-hooking, along with not impeding storage of the helmet or any deterring object within the inner compartment 52.

The straps may further have an additional securing or hooking means onto complementary portion disposed or fixed on the surface of the inner lining to prevent sliding of the back-pack through the slits. Alternatively, the straps may directly secure or hook onto this complementary portion disposed on the inner lining to prevent sliding.

Figure 6:
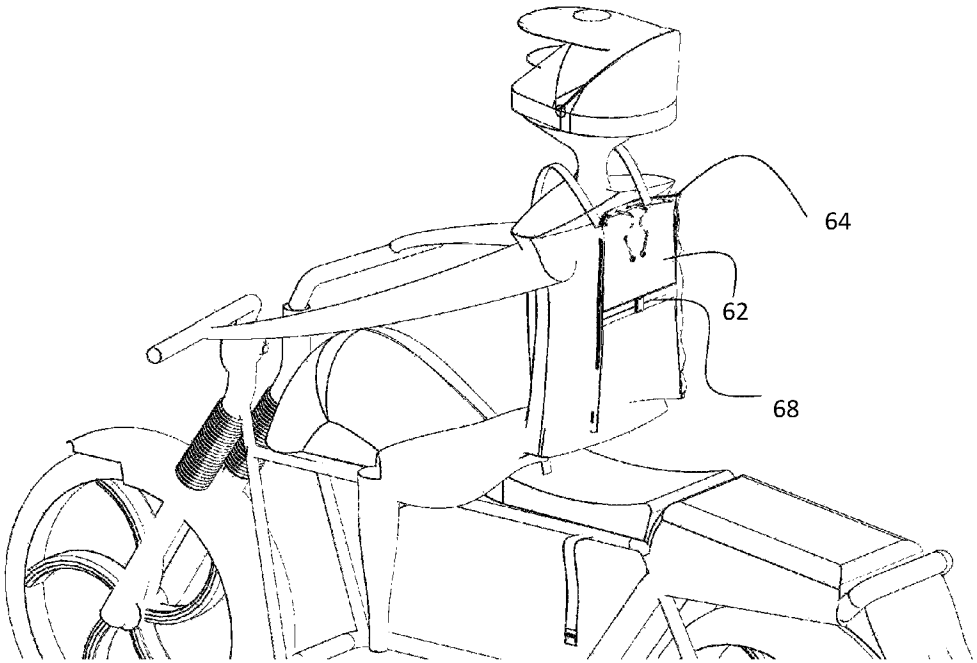
FIG. 6 depicts the back-pack worn over the shoulders of a motorcyclist while the motorcycle is in operation.

FIG. 6 depicts the back-pack worn over the shoulders of a motorcyclist while the motorcycle is in operation. As shown, the back-pack 62 is depicted as a tote-bag with a cinch-draw top portion 64 with its sides 66 folded in forwardly and secured into a compact or cylindrical form by a side buckle 68. In this compact or cylindrical form, the back-pack offers minimal wind resistance while the user is operating the motorcycle. Alternatively, the sides 66 may fold backwardly and secured into the cylindrical form by a side buckle 68. While not shown, the cinch-draw top portion 64 may additionally have a flap to cover over the top portion 64 and optionally buckle to the same side buckle 68, or optionally, to a dedicated buckle. It is also to be appreciated that a buckle could be replaced with any standard securing means known in the art, such as hooks, loops, carabiners, etc. These securing means may also apply to the terminal distal ends of the straps within the inner compartment of the back-pack to secure the straps and securely mount the back-pack onto the top surface of the seat for providing mount deterrence (FIG. 5).

While not shown in FIG. 6, alternative styles or form-factors may be applied to the back-pack. The only design constraint is that the top portion and inner compartment needs to be large enough or expand enough to accommodate the size and shape of a helmet to form a deterring bulge or hump. Alternatively, any other similarly sized and shaped object may be housed in the back-pack to form comparably deterring bulge or hump. Other styles and form factors may be a back-pack with a zippered front face or a buckled top flap. Moreover, alternatively, any one of the tote, zippered, or buckled back-pack may not fold in to form the cylindrical form—and remain unfolded on the back of the user-even at the risk of increasing wind resistance during operation.

While also not shown in FIG. 6, any number of additional compartments accessible from within or from outside may be provided. For instance, a bottom portion that is zippered may be practical for storing items, such as shoes, etc. Additionally, smaller compartments within the larger inner compartment may be provided for storage of smaller items, such as a wallet, key, mobile phone, etc.

Figure 7:
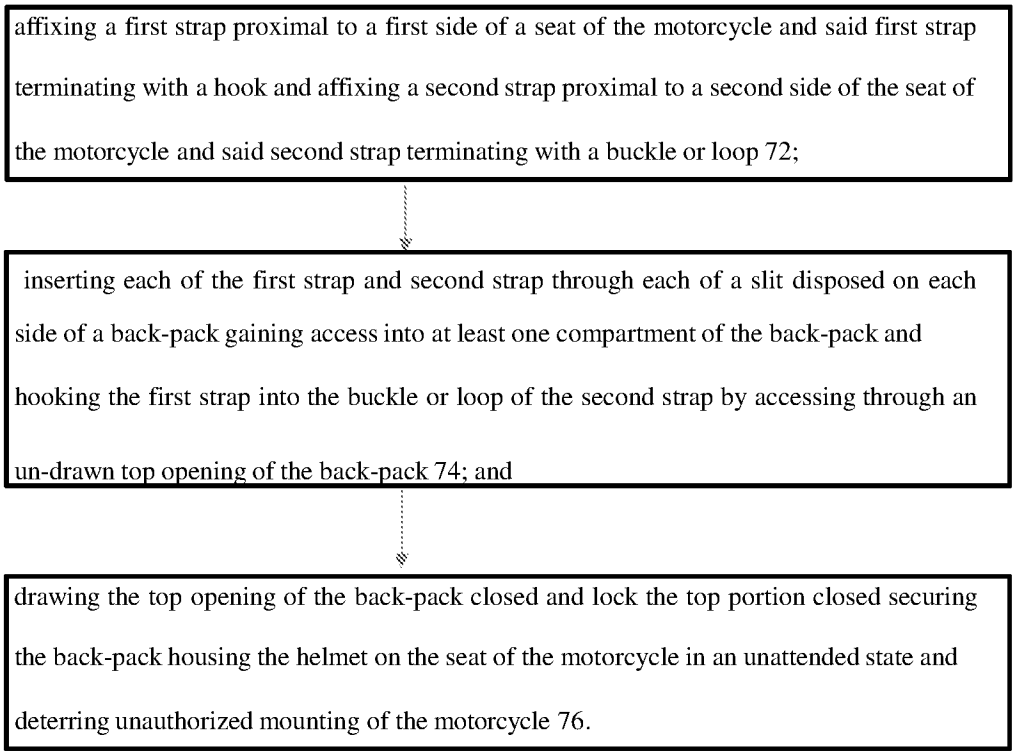
FIG. 7 depicts a method flow diagram in accordance with an aspect of the invention.

FIG. 7 depicts a method flow diagram in accordance with an aspect of the invention. A method for preventing unauthorized straddling of a motorcycle comprises the steps of: (1) affixing a first strap proximal to a first side of a seat of the motorcycle and said first strap terminating with a hook and affixing a second strap proximal to a second side of the seat of the motorcycle and said second strap terminating with a buckle or loop 72; (2) inserting each of the first strap and second strap through each of a slit disposed on each side of a back-pack gaining access into at least one compartment of the back-pack and hooking the first strap into the buckle or loop of the second strap by accessing through an un-drawn top opening of the back-pack 74; and (3) drawing the top opening of the back-pack closed and lock the top portion closed securing the back-pack housing the helmet on the seat of the motorcycle in an unattended state and deterring unauthorized mounting of the motorcycle 76.

In a preferred embodiment, the back-pack is comprised of at least one of a nylon, canvas, and/or leather. Any one of a style or form-factor may be used, so long as it can house an object the size and shape of a helmet and lock from at least one outer point. Preferably, an additional left and right flap cover may be disposed on the front face or surface that hook in to unite and form the cylinder while worn in the operational state. In a stationary and unattended state, the flaps may un-roll to drape down over the sides of the seat, much like a drape or skirt, to further conceal the motorcycle. Alternatively, the back-pack may fold in and create the cylindrical form without the front-faced flaps, and just have the sides of the back-pack rolled or folded in.

The straps, extending from the under-seat mounted plate, may be each slipped through a specifically conformed slit on each side of the back-pack, hooking to each other within an inner compartment to securely mount the backpack on the seat of the motorcycle. Each specifically conformed slit is just wide enough for passage of the strap with any one of a terminal end (hook, loop, or buckle) and is specifically designed to prevent a persons hand from passing through. The terminal end of each strap is hooked within the inner compartment through the top opening portion. Once the straps are hooked and the back-pack is securely mounted onto the seat, the user may place his or her helmet within the inner compartment. The back-pack may be accessed by the user through a top opening portion that is cinch-drawn. Alternatively, access may be gained for hooking/un-hooking the straps and placing/removing the helmet through a top opening flap, front-face zipper or hook. Given the expense of the helmet and a need to prevent removal of the back-pack from the seat by a mounter, it is imperative to have any one of a locking means on at least one of a top opening portion, cinch-draw, front face zipper or hook, accessing the inner compartment. It is to be appreciated that any number of compartments, with or without separate locking means, may be provided without departing from the scope of the invention. However, the inner compartment housing the helmet and securing straps must be lockable by any type of locking means, preferably by a standard lock, sold with or separately.

The foregoing descriptions of specific embodiments of the invention have been presented for purposes of illustration and description. They are not intended to be exhaustive or to limit the invention to the precise forms disclosed. Modifications and variations are possible in light of the above teaching. The embodiments were chosen and described in order to explain the principles and the application of the invention, thereby enabling others skilled in the art to utilize the invention in its various embodiments and modifications according to the particular purpose contemplated. The scope of the invention is intended to be defined by the claims appended hereto and their equivalents.

I claim:

1. An apparatus for providing a motorcycle mount deterrence, said apparatus comprising:

a back-pack of foldable material with a back surface, a front surface, one side, another side, a slit on each side, a bottom surface, a top surface with a draw-string opening for accessing at least one compartment, and at least one over-the-shoulder strap disposed on the back surface;

said back-pack to rest on a top surface of a seat of a motorcycle, wherein the back-pack covers at least a portion of a top surface of the seat of the motorcycle;

a first strap, free from the back-pack, with one end affixed proximal to a first side of the seat of the motorcycle and and a second end with a hook and a second strap, free from the back-pack, with one end affixed proximal to a second side of the seat of the motorcycle and a second end with a buckle or loop;

each of the first strap and second strap inserted through each of the slits disposed on each of the sides of the back-pack gaining access into the at least one compartment of the back-pack and the hook of the first strap hooked into the buckle or loop of the second strap by access through the un-drawn top opening of the back-pack; and draw the top portion of the back-pack closed and lock the top portion closed securing the back-pack housing a helmet on the seat of the motorcycle in an unattended state and deterring unauthorized mounting of the motorcycle and restricting access into the compartment for access to at least one of the helmet and/or hook for un-hooking the straps and removing the back-pack from the seat of the motorcycle by anyone unauthorized.

2. The apparatus of claim 1, wherein the back- pack is comprised of at least one of a nylon, canvas, and/or leather.

3. The apparatus of claim 1, wherein the front surface comprises an additional left and right flap cover that hooks in to unite and form a cylinder while worn in the operational state.

4. The apparatus of claim 3, wherein the right and left flap un-hooks to split and form a skirt or saddle on each side of the motorcycle in the unattended state.

5. The apparatus of claim 1, wherein the straps are comprised of at least one of a cut-resistant material, abrasion-resistant material, or tear-resistant material.

6. The apparatus of claim 5, wherein the straps at one end terminate in at least one of a hook, buckle, or loop, and terminate at an opposing end in an end piece configured to screw between the seat and frame of the motorcycle.

7. An apparatus preventing unauthorized straddling of a motorcycle, said apparatus comprising:

a first strap end affixed between a seat of the motorcycle and a frame of the motorcycle, and said first strap terminating with a hook in an opposing end and a second strap end affixed between the seat of the motorcycle and a frame of the motorcycle, and said second strap terminating with a buckle or loop configured to securely fit the hook of the first strap;

a back-pack, free from the straps, with slits disposed on each side of the back-pack, wherein each of the first strap and second strap terminating ends inserted through each of the slits disposed on each side of the back-pack and the hook of the first strap hooked into the buckle or loop of the second strap by accessing through an un-drawn top opening of the back-pack; and draw the top portion of the back-pack closed and securely close the top portion closed securing the back-pack housing a helmet on the seat of the motorcycle in an unattended state and deterring unauthorized mounting of the motorcycle.

8. The apparatus of claim 7, wherein the back- pack is comprised of at least one of a nylon, canvas, and/or leather.

9. The apparatus of claim 7, wherein the front surface comprises an additional left and right flap cover that hooks in to unite and form a cylinder while worn in the operational state.

10. The apparatus of claim 7, wherein the right and left flap un-hooks to split and form a skirt or drape on each side of the motorcycle in the unattended state.

11. The apparatus of claim 7, wherein the straps are comprised of at least one of a cut-resistant material, abrasion-resistant material, or tear-resistant material.

12. The apparatus of claim 11, wherein the straps at one end terminate in at least one of the hook, buckle, or loop at a terminal end, and terminate at a proximal end in a screw-mountable plate to be screwed into a frame or chassis of the motorcycle.

13. A method for preventing unauthorized straddling of a motorcycle, said method comprising the steps of:

affixing a first strap end between a seat of the motorcycle and a frame of the motorcycle, and said first strap terminating with a hook in an opposing end and affixing a second strap between the seat of the motorcycle and the frame of the motorcycle, and said second strap terminating with a buckle or loop configured to securely fit the hook of the first strap;

inserting each of the first strap and second strap terminating ends through each of a slit disposed on each side of a back-pack and hooking the first strap into the buckle or loop of the second strap by accessing through an un-drawn top opening of the back-pack; and drawing the top opening of the back-pack closed and securely closing the top portion of the back-pack housing a helmet on the seat of the motorcycle in an unattended state and deterring unauthorized mounting of the motorcycle.

14. The method of claim 13, wherein the back-pack is comprised of at least one of a nylon, canvas, and/or leather.

15. The method of claim 13, wherein the front surface comprises an additional left and right flap cover that hook in to unite and form a cylinder while worn in the operational state.

16. The method of claim 15, wherein the right and left flap un-hooks to split and form a skirt or drape on each side of the motorcycle in the unattended state.

17. The method of claim 13, wherein the straps are comprised of at least one of a cut-resistant material, abrasion-resistant material, or tear-resistant material.

18. The apparatus of claim 17, wherein the straps at one end terminate in at least one of a hook, buckle, or loop at a terminal end, and terminate at a proximal end in a screw-mountable plate.

19. The method of claim 13, wherein the back- pack comprises a form-factor configured to house any spherical, cubic, rectangular, elliptical, semi-spherical, or semi-elliptical object large enough to cover at least a partial surface of the motorcycle seat.

20. The method of claim 13, further comprising a hook at a first side of the back-pack and a buckle on a second side in order to allow the back-pack to fold in or out to form a compact or cylindrical form.

* * * * *